US007785763B2

(12) United States Patent
Agur et al.

(10) Patent No.: US 7,785,763 B2
(45) **Date of Patent: *Aug. 31, 2010**

(54) EMULSION AGGREGATION PROCESSES

(75) Inventors: Enno E. Agur, Toronto (CA); Guerino G. Sacripante, Oakville (CA); Michael S. Hawkins, Cambridge (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 992 days.

This patent is subject to a terminal disclaimer.

(21) Appl. No.: 11/549,249

(22) Filed: Oct. 13, 2006

(65) Prior Publication Data

US 2008/0090163 A1 Apr. 17, 2008

(51) Int. Cl.
*G03G 9/08* (2006.01)

(52) U.S. Cl. ..... 430/137.14; 430/109.4

(58) Field of Classification Search ..... 430/137.14, 430/109.4

See application file for complete search history.

(56) References Cited

U.S. PATENT DOCUMENTS

| | | | |
|---|---|---|---|
| 3,847,604 | A | 11/1974 | Hagenbach et al. |
| 4,338,390 | A | 7/1982 | Lu |
| 4,935,326 | A | 6/1990 | Creatura et al. |
| 4,937,166 | A | 6/1990 | Creatura et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 5,994,020 | A | 11/1999 | Patel et al. |
| 6,395,442 | B1 | 5/2002 | Hayashi et al. |
| 6,576,389 | B2 | 6/2003 | Vanbesien et al. |
| 6,617,092 | B1 | 9/2003 | Patel et al. |
| 6,627,373 | B1 | 9/2003 | Patel et al. |
| 6,638,677 | B2 | 10/2003 | Patel et al. |
| 6,656,657 | B2 | 12/2003 | Patel et al. |
| 6,656,658 | B2 | 12/2003 | Patel et al. |
| 6,664,017 | B1 | 12/2003 | Patel et al. |
| 6,673,505 | B2 | 1/2004 | Jiang et al. |
| 6,677,097 | B2 | 1/2004 | Ohmura et al. |
| 6,730,450 | B1 | 5/2004 | Moffat et al. |
| 6,743,559 | B2 | 6/2004 | Combes et al. |
| 6,756,176 | B2 | 6/2004 | Stegamat et al. |
| 6,780,500 | B2 | 8/2004 | Dumouchel et al. |
| 6,830,860 | B2 | 12/2004 | Sacripante et al. |
| 7,029,817 | B2 * | 4/2006 | Robinson et al. ..... 430/137.14 |
| 2005/0181296 | A1 * | 8/2005 | Robinson et al. ..... 430/137.14 |

OTHER PUBLICATIONS

American Chemical Society (ACS) File Registry No. 23192-42-9, copyright 2010 ACS on STN, which was entered in STN on Nov. 16, 1984.*

* cited by examiner

*Primary Examiner*—Janis L Dote
(74) *Attorney, Agent, or Firm*—Oliff & Berridge, PLC

(57) ABSTRACT

A process for preparing a toner, includes solvent flashing wax and resin together to emulsify the resin and wax to a sub-micro size; mixing the wax and resin emulsion with a colorant, and optionally a coagulant to form a mixture; heating the mixture at a temperature below a glass transition temperature of the resin to aggregate the resin, colorant, and wax, to form aggregated particles; heating the aggregated particles and coalescent agent at a temperature above the glass transition temperature of said resin, to coalesce the aggregated particles to form toner particles, optionally cooling the mixture; and isolating the toner particles.

24 Claims, No Drawings

EMULSION AGGREGATION PROCESSES

TECHNICAL FIELD

This disclosure is generally directed to toner processes, and more specifically, emulsion aggregation and coalescence processes, as well as toner compositions formed by such processes that include a wax component. More specifically, this disclosure is directed to methods for the preparation of resin- and wax-containing toner compositions by a chemical process, such as emulsion aggregation, where an emulsion containing resin and wax is first formed for incorporation into the toner. Yet more specifically, this disclosure is directed to emulsion aggregation and coalescences processes for the preparation of resin and wax containing toners where the emulsion containing said resin and wax is formed by solvent flashing, and said resin is a polyester.

BACKGROUND

Illustrated herein in embodiments are toner processes, and more specifically, emulsion aggregation and coalescence processes. More specifically, disclosed in embodiments are methods for the preparation of toner compositions that include a wax component by a chemical process, such as emulsion aggregation. In the process, polyester toner binder resin (for example, a crystalline polyester or a mixture of crystalline polyesters or an amorphous polyester or a mixture of amorphous polyesters), are solvent flashed together with wax to emulsify the resin and wax for incorporation into the toner. The resin and wax combination is then aggregated with the optional addition of a colorant dispersion and/or additional wax emulsion, shearing and adding an aqueous solution of acid until the pH of the mixture is from about 4.0 to about 5.5, heating to a temperature of from about 30° C. to below the glass transition temperature (Tg) of said resin, wherein the aggregate grows to a size of from about 3 to about 20 microns, raising the pH of the mixture to a range of about 7 to 9, heating the mixture to above the resin Tg to coalesce said aggregate, and optionally decreasing the pH to a range of 6.0 to 6.8 to provide toner size particles.

Waxes are generally added to toner compositions in order to aid in toner release from the fuser roll during fusing. Wax also helps release of the fused image document from the fuser roll, that is, to prevent the fused image document from curling around the fuser roll. Wax is especially useful for this purpose in oil-less fuser designs, where oil such as silicone oil is not present to perform these functions. Further, waxes in toner formulations aid in the prevention of document offset, where it is undesirable for fused images on documents in contact over a prolonged period of time or at elevated temperatures to be transferred from one document to another (toner-to-toner and toner-to-paper). In fuser designs that utilize stripper fingers to aid the removal of the fused image document from the fuser roll, waxes are also generally added to the toner formulations in order to reduce the occurrence of stripper finger marks on the fused images (scratch marks, changes in image gloss, and the like).

Carnauba waxes, such as RC-160 (Toa Kasei Co., Ltd., Japan), and fatty acid amide waxes, such as KEMAMIDE S-180 stearyl stearamide wax (Crompton-Witco, USA) are particularly useful in polyester toner designs such as for application where high gloss is a requirement. In classical emulsion aggregation toner processes, wax has been added to the toner formulation in the form of an aqueous emulsion or dispersion of solid wax in water where the solid wax particle size is, for example, in the range from about 100 to about 500 nanometers. The solid wax particles in the emulsions need to be stabilized with an emulsifier such as for example a surfactant. Processes for producing wax emulsions wherein surfactants are used as stabilizers are well known. For example, RC-160 carnauba wax can be emulsified by mixing it into deionized water containing about 2.5 parts per hundred (surfactant to wax ratio) anionic surfactant, heating the mixture to about 105° C. in a closed reactor, homogenizing the mixture for about 45 minutes at 8,000 pounds per square inch in a high pressure piston homogenizer, and then cooling the product to room temperature.

To achieve desired low temperature fusing performance in toner formulations, it has been found advantageous to utilize a blend of crystalline and amorphous resins such as polyester resins in the toner formulations. Crystalline resins alone in toners generally provide excellent low temperature fusing and high gloss performance, but generally provide poor fusing latitude. Amorphous resins alone generally provide excellent release performance, but generally their low temperature fusing performance is limited by blocking and document offset requirements. By mixing both crystalline and amorphous resins, one can achieve both low temperature fusing performance and wide fusing latitude.

In some toner formulations, sulfonated polyesters have been used in the resin designs wherein the sulfonated groups enhanced the emulsifiability of the resin and promoted the aggregation and coalescence performance in toner preparation. However, in some cases it has been demonstrated that the presence of the sulfonated groups is detrimental to blocking performance and relative humidity (RH) sensitivity at high temperature and high humidity (about 80° F. and about 80 to about 85 percent relative humidity).

A known process for emulsifying nonsulfonated polyester resins is by solvent flashing wherein the resin is dissolved in an organic solvent such as for example ethyl acetate at an elevated temperature but below the boiling point of said solvent such as for example 65° C. The resulting solution is mixed into water containing an anionic surfactant such as Taycapower BN2060 (Tayca Corp., Japan), mixed with a homogenizer and then heated to a further elevated temperature above the boiling point of said solvent such as for example 80° C. to flash off the solvent and then cooled to room temperature.

Robust and repeatable aggregation and coalescence performance has proved to be a challenge in working with high acid number (such as greater than about 12 milligrams KOH per gram) polyester resins containing substantially no sulfonated groups and stabilized with anionic surfactants. Improved success, however, has been demonstrated in processes containing resin and pigment by significantly reducing the amount of surfactant in the ingredients and utilizing pH adjustment or aluminum sulfate for coagulation resulting in excellent relative humidity and high temperature/high humidity charging performance. To enable low-surfactant aggregation and coalescence toner processes, it has been possible to produce crystalline and amorphous linear polyester emulsions containing substantially no surfactant by solvent flashing, wherein the resins are stabilized with bases such as for example sodium bicarbonate or ammonium hydroxide.

The incorporation of wax emulsion stabilized with anionic surfactants into the emulsion and aggregation toner processes containing reduced levels of surfactants has proved to be further challenging. Still further, it has not been able to produce surfactantless wax emulsions. More specifically, attempts to solvent flash waxes such as carnauba wax or stearyl stearamide wax utilizing sodium bicarbonate as the stabilizer wherein the wax is dissolved in ethyl acetate at 65°

C. have not been successful. It has proved to be advantageous to incorporate wax into the toner processes wherein the polyester resin and wax are emulsified together utilizing bases such as for example sodium bicarbonate or ammonium hydroxide as the stabilizer such as by solvent flashing and with reduced or substantially no surfactant.

Reducing the addition of surfactants into the emulsion aggregation process toner has a further advantage of reducing the need to remove the surfactants in toner washing processes such as to enable satisfactory toner charging and development performance.

Yet further, emulsifying wax to submicron sizes can be a costly process. Alternatives to wax emulsification such as by combining it with resin emulsification are thus even further desired.

The processes of the disclosure, in embodiments, provide a means for toner compositions to be made faster and at lower cost utilizing nonsulfonated polyester resins, by allowing the resin and wax to be emulsified together by solvent flashing with reduced or substantially no surfactants such as to enable substantially complete incorporation of said resin and wax into the toner.

REFERENCES

In U.S. Pat. No. 6,395,442, there is illustrated a toner for electrophotography. The resin binder is obtained by fusing fine resin particles comprising a crystalline material and amorphous polymer in a water-based medium. The crystalline material preferably has a melting point of 60 to 130° C., a number average molecular weight of 1,500 to 15,000, and a melt viscosity at the melting point +20° C. of not more than 100 Pa·s, and the amorphous polymer is preferably composed of a radically polymerizable monomer.

Illustrated in U.S. Pat. No. 5,994,020, are toner preparation processes, and more specifically, a process for the preparation of toner comprising:

(i) preparing, or providing a colorant dispersion;

(ii) preparing, or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vii) separating the toner particles; and a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally cooling, isolating, washing, and drying the toner.

Emulsion aggregation/coalescing processes for the preparation of toners are illustrated in a number of Xerox patents, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210. Other patents disclosing exemplary emulsion aggregation/coalescing processes include, for example, U.S. Pat. Nos. 6,730,450, 6,743,559, 6,756,176, 6,780,500, 6,830,860, and 7,029,817.

The disclosures of each of the foregoing patents and publications are hereby incorporated by reference herein in their entireties. The appropriate components and process aspects of the each of the foregoing patents and publications may also be selected for the present compositions and processes in embodiments thereof.

SUMMARY

Although development processes are known that do not require wax-containing toners, such as development processes that use silicone oil release agents, such oil fusing systems pose some undesirable issues. For example, a development process that does not use a release oil, or that uses low amounts of release oil, could reduce or alleviate issues such as caused by toner-fuser oil interactions, oil contamination, and the like. For a low-oil or no-oil fuser to function properly, however, it is generally necessary to include wax in the toner formulation.

A toner composition and a process for preparing a toner including, for example, an emulsion aggregation process for preparing a toner, are described. The toner composition comprises, for example, resin such as a polyester resin, a colorant, a wax, and optionally a coagulant such as a monovalent metal, divalent metal, or polyion coagulant, wherein the toner is prepared by an emulsion aggregation process. The resin can be a crystalline or an amorphous polymeric resin, or a mixture thereof. In embodiments, the process for making the toner with reduced or substantially no surfactants and without metal coagulants, involves forming a latex by generating an emulsion of a polyester resin having an acid value of from about 16 to about 40 mg KOH/gram, dissolving the polyester resin and wax in an organic solvent, neutralizing the acid groups with an alkali base and optionally further stabilizing the resin and wax with surfactants, dispersing in water followed by heating to remove the organic solvent, and optionally adding to the emulsion a colorant dispersion and/or a wax dispersion, shearing and adding an aqueous solution of acid until the pH of the mixture is from about 4.0 to about 5.5, heating to a temperature of from about 30° C. to 60° C., wherein the aggregate grows to a size of from about 3 to about 20 microns, raising the pH of the mixture to a range of about 7 to 9, heating the mixture to about 75° C. to about 95° C., optionally decreasing the pH to a range of 6.0 to 6.8, cooling the mixture, and optionally, isolating the toner. In other embodiments, the process for making the toner with a coagulant and with reduced or substantially no surfactants, involves forming a latex by generating an emulsion of a polyester resin and wax, dissolving the polyester resin and wax in an organic solvent, neutralizing the acid groups with an alkali base and optionally further stabilizing said resin and wax with surfactants, dispersing in water followed by heating to remove the organic solvent, adding thereto a pigment dispersion for example from about 4 to about 25 percent by weight of toner, optionally a wax dispersion for example from about 5 to about 25 percent by weight of toner, and optionally a surfactant for example from about 0.1 to about 3 percent by weight of toner, and shearing with a homogenizer and adding an aqueous solution of acid, such as nitric acid, from about 0.01 to about 1 molar, until the pH of the mixture is, for example, from about 2.5 to about 4, followed by adding an aqueous solution of coagulant during homogenization and thereby generating an initial aggregate composite with a size for example of from about 1 to about 3 microns, heating to a temperature of from about 30° C. to about 60° C. and wherein the aggregate composite grows to a size for example of from about 3 to about 20 microns, such as from about 3 to about 11 microns, raising the pH of the mixture to a range of for example from about 7 to about 9 and heating the mixture to for example from about 75° C. to about 95° C., optionally decreasing the pH to a range of for example from about 6.0 to about 6.8, cooling the mixture and optionally, isolating the toner. In further embodiments, the toner process provides toner particles having a desired round or spherical shape, and the toner is produced in a relatively shorter time and at a relatively lower process temperature.

In an embodiment, the disclosure provides a process for preparing a toner, comprising: solvent flashing wax and resin together to emulsify the resin and wax to a sub-micron size; mixing the wax and resin emulsion with a colorant, and optionally a coagulant to form a mixture; heating the mixture at a temperature below a glass transition temperature of said resin to aggregate said resin, colorant, and wax, to form aggregated particles; heating the aggregated particles and coalescent agent at a temperature above the glass transition temperature of said resin, to coalesce said aggregated particles to form toner particles, optionally cooling the mixture; and isolating the toner particles. The solvent flashing can comprise: dissolving the wax and resin in an organic solvent; mixing the wax, resin and solvent into an emulsion medium to form a wax and resin emulsion; mixing the wax and resin emulsion; and heating the wax and resin emulsion to flash off the solvent.

Embodiments

The toner of the present disclosure is comprised of toner particles comprised of at least a resin such as a polyester polymer resin, a wax, a colorant, and an optional coagulant. The toner particles may also include other conventional optional additives, such as colloidal silica (as a flow agent) and the like. Beneficially, the toner of embodiments is made by a process that includes dissolving the wax component with the resin in an organic solvent, and emulsifying the mixture in a solvent flashing process with reduced or substantially no surfactant. A benefit of the solvent flashing process is that it provides for a resin and wax emulsion such that substantially all of the resin and wax is incorporated in the toner particles. Further, it avoids the necessity of emulsifying the wax as an extra step. Still further, it enables wax particles to be emulsified, which alone cannot be emulsified with reduced or substantially without surfactants.

The specific latex for resin, polymer or polymers selected for the toner of the present disclosure include polyester and/or its derivatives, including polyester resins and branched polyester resins, polyimide resins, branched polyimide resins, poly(styrene -acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, cross linked alkali sulfonated poly(styrene-acrylate) resins, poly(styrene-methacrylate) resins, crosslinked alkali sulfonated-poly(styrene-methacrylate) resins, alkali sulfonated-poly(styrene -butadiene) resins, crosslinked alkali sulfonated poly(styrene-butadiene) resins, and crystalline polyester resins.

The resin can be selected from the group consisting of an amorphous resin, a crystalline resin, a mixture of two or more amorphous resins, and a mixture of two or more crystalline resins. Illustrative examples of polymer resins selected for the process and particles of the present disclosure include any of the various polyesters, such as crystalline polyesters, amorphous polyesters, or a mixture thereof. Thus, for example, the toner particles can be comprised of crystalline polyester resins, amorphous polyester resins, or a mixture of two or more polyester resins where one or more polyester is crystalline and one or more polyester is amorphous.

Illustrative examples of crystalline polymer resins selected for the process and particles of the present disclosure include any of the various crystalline polyesters, such as poly(ethylene-adipate), poly(propylene-adipate), poly(butylene-adipate), poly(pentylene-adipate), poly(hexylene-adipate), poly (octylene-adipate), poly(ethylene-succinate), poly (propylene-succinate), poly(butylene-succinate), poly (pentylene-succinate), poly(hexylene-succinate), poly (octylene-succinate), poly(ethylene-sebacate), poly (propylene-sebacate), poly(butylene-sebacate), poly(pentylene-sebacate), poly(hexylene-sebacate), poly(octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly (butylene-adipate), copoly(5-sulfo-isophthaloyl)-copoly(pentylene-adipate), copoly (5-sulfo-isophthaloyl)-copoly(hexylene-adipate), copoly(5-sulfo-isophthaloyl)-copoly (octylene-adipate), copoly(5-sulfo-isophthaloyl)-copoly(ethylene-adipate), copoly(5-sulfoisophthaloyl)-copoly(propylene-adipate), copoly(5-sulfo-isophthaloyl)-copoly(butylene -adipate), copoly(5-sulfo-isophthaloyl)-copoly(pentylene-adipate), copoly(5-sulfo -isophthaloyl)-copoly(hexylene-adipate), copoly(5-sulfo-isophthaloyl)-copoly(octylene -adipate), copoly(5-sulfoisophthaloyl)-copoly(ethylene-succinate), copoly(5-sulfoisophthaloyl)-copoly(propylene-succinate), copoly(5-sulfoisophthaloyl) -copoly(butylene -succinate), copoly(5-sulfoisophthaloyl)-copoly(pentylene-succinate), copoly(5-sulfoisophthaloyl)-copoly(hexylene-succinate), copoly(5-sulfoisophthaloyl) -copoly(octylene -succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes -sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene -sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene -adipate), copoly(5-sulfo-isophthaloyl)-copoly(pentylene-adipate), copoly(5-sulfo-isophthaloyl)-copoly(hexylene-adipate), or poly(octylene-adipate), or mixtures thereof.

The crystalline resins, which are available from a number of sources, can possess various melting points of, for example, from about 30° C. to about 120° C., such as from about 50° C. to about 90° C. The crystalline resin may have, for example, a number average molecular weight (Mn), as measured by gel permeation chromatography (GPC) of, for example, from about 1,000 to about 50,000, and preferably from about 2,000 to about 25,000. The weight average molecular weight (Mw) of the resin may be, for example, from about 2,000 to about 100,000, and preferably from about 3,000 to about 80,000, as determined by GPC using polystyrene standards. The molecular weight distribution (Mw/Mn) of the crystalline resin is, for example, from about 2 to about 6, and more specifically, from about 2 to about 4.

The crystalline resins can be prepared by a polycondensation process by reacting suitable organic diol(s) and suitable organic diacid(s) in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, naphtalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo -phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo -terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Illustrative examples of amorphous polymer resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptylene-terephthalate, polylene-terephthalate,polyethylene-sebacate, polypropylene sebacate, polybutylene-sebacate, polyethylene-adipate, polypropylene-adipate, polybutylene-adipate, polypentylene-adipate, polyhexylene-adipate polyheptylene-adipate, polyoctylene-adipate, polyethylene-glutarate, polypropylene-glutarate, polybutylene-glutarate, polypentylene-glutarate, polyhexylene-glutarate, polyheptylene-glutarate, polyoctylene-glutarate, polyethylene-pimelate, polypropylene-pimelate, polybutylene-pimelate, polypentylene-pimelate, polyhexylene-pimelate, polyheptylene-pimelate, poly(propoxylated bisphenol-fumarate), poly(propoxylated bisphenol-succinate), poly(propoxylated bisphenol-adipate), poly (propoxylated bisphenol-glutarate), SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation) mixtures thereof and the like. The resins can also be functionalized, such as carboxylated, sulfonated, or the like, and particularly such as sodio sulfonated, if desired. The resin can also be a non-sulfonated polyester resin.

The amorphous resins, linear or branched, which are available from a number of sources, can possess various onset Tg's of, for example, from about 40° C. to about 80° C., such as from about 50° C. to about 70° C. as measured by differential scanning calorimetry (DSC). The linear and branched amorphous polyester resins, in embodiments, possess, for example, a number average molecular weight (Mn), as measured by GPC, of from about 10,000 to about 500,000, such as from about 5,000 to about 250,000; a weight average molecular weight (Mw) of, for example, from about 20,000 to about 600,000, such as from about 7,000 to about 300,000, as determined by GPC using polystyrene standards; and a molecular weight distribution (Mw/Mn) of, for example, from about 1.5 to about 6, such as from about 2 to about 4.

The linear amorphous polyester resins are generally prepared by the polycondensation of an organic diol, a diacid or diester, and a polycondensation catalyst. For the branched amorphous sulfonated polyester resin, the same materials may be used, with the further inclusion of a branching agent such as a multivalent polyacid or polyol. The amorphous resin is generally present in the toner composition in various suitable amounts, such as from about 60 to about 90 weight percent, or from about 50 to about 65 weight percent, of the toner or of the solids.

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole percent of the resin. Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and mixtures thereof. The amount of organic diol selected can vary, and more specifically, is, for example, from about 45 to about 52 mole percent of the resin.

Branching agents for use in forming the branched amorphous sulfonated polyester include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Examples of suitable polycondensation catalyst for either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

The polymer resin may be present in an amount of from about 65 to about 95 percent by weight, or preferably from about 75 to about 85 percent by weight of the toner particles (that is, toner particles exclusive of external additives) on a solids basis. The ratio of crystalline resin to amorphous resin can be in the range from about 1:99 to about 30:70, such as from about 5:95 to about 25:75. However, amounts and ratios outside of these ranges can be used, in embodiments, depending upon the type and amounts of other materials present.

The monomers used in making the selected polymer are not limited, and the monomers utilized may include any one or more of, for example, ethylene, propylene, and the like. Known chain transfer agents, for example dodecanethiol or carbon tetrabromide, can be utilized to control the molecular weight properties of the polymer. Any suitable method for forming the polymer from the monomers may be used without restriction.

In addition to the polymer binder resin, the toners of the present disclosure also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes and functionalized waxes. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, and polypropylene wax, and mixtures thereof.

Examples of waxes of embodiments include polypropylenes and polyethylenes commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 1,000 to about 1,500, while the commercially available polypropylenes utilized have a molecular weight of about 4.000 to about 5,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and Johnson Diversey, Inc. Many of the polyethylene and polypropylene compositions useful in embodiments are illustrated in British Pat. No. 1,442,835, the entire disclosure of which is incorporated herein by reference.

To facilitate formation of the resin and wax emulsion, the wax should be soluble in the solvent, and at the temperature used to dissolve the resin for solvent flashing. If these properties are not met, then the resin and wax emulsion will not be formed in the solvent flashing process. One skilled in the art will be able to readily determine or test specific waxes, in combination with specific resins and specific solvents, for their adequacy. Thus, for example, many polyolefin waxes, such as polyethylenes and polypropylenes, are not soluble and thus cannot be used.

In addition, in embodiments, the wax is selected such that the wax does not plastify, or does not substantially plastify, -the amorphous or crystalline resin during solvent flashing, wherein the glass transition temperature of an amorphous polyester resin is substantially lowered or the melting point of a crystalline polyester may be substantially lowered. That is, the wax and resin mixture should exhibit separate melting and/or Tg peaks in the DSC plot.

The toners may contain the wax in any amount of from, for example, about 3 to about 15 percent by weight of the toner, on a dry basis. For example, the toners can contain from about 5 to about 11 percent by weight of the wax.

For conventional emulsion aggregation processes, the resin latex or emulsion can be prepared by any suitable means. For example, the latex or emulsion is prepared by taking the resin and heating it to its melting temperature and dispersing the resin in an aqueous phase containing a surfactant. The dispersion is carried out by various dispersing equipment such as an ultimizer, high speed honogenizer, or the like to provide submicron resin particles (particles having an average diameter or particle size of less than about 1 micron). Other ways to prepare the resin latex or emulsion include solubilizing the resin in a solvent and adding it to heated water to flash evaporate the solvent. External dispersions have also been employed to assist the formation of emulsion as the solvent is being evaporated. Likewise, to incorporate the wax into the toner, it has been known for the wax to be in the form of one or more aqueous emulsions or dispersions of solid wax in water, where the solid wax particle size is usually in the range of from about 100 to about 500 nm.

According to embodiments, the resin and wax are incorporated into the toner composition together, in the form of a single dispersion. That combined resin and wax dispersion is made by solvent flashing the wax and resin components, such as wax and resin particles, to emulsify the resin and wax to a sub-micron size. The wax and resin emulsion can then be mixed with a colorant, and optionally a coagulant to form a mixture for further processing according to known processes. In embodiments, the step of forming and solvent flashing the wax and resin emulsion can be carried out in an organic solvent, and either with the use of a surfactant or with the use of reduced, substantially no, or even no surfactant as stabilizer. This allows the entire toner process to be conducted with reduced amounts of surfactant.

After the wax and resin are dissolved in the solvent, the resin and wax solution is mixed into an emulsion medium, for example water such as deionized water containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates and alkali metal bicarbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present at a level of from about 0.1 to about 5 percent, such as about 0.5 to about 3 percent by weight of the wax and resin. When such salts are added to the composition as a stabilizer, it is desired in embodiments that incompatible metal salts are not present in the composition. For example, when these salts are used the composition should be completely or essentially free of zinc and other incompatible metal ions, e.g., Ca, Fe, Ba, etc. which form water-insoluble salts. The term "essentially free" refers, for example, to the incompatible metal ions as present at a level of less than about 0.01 percent, such as less than about 0.005 or less than about 0.001 percent by weight of the wax and resin. If desired or necessary, the stabilizer can be added to the mixture at ambient temperature, or it can be heated to the mixture temperature prior to addition.

Efforts to produce wax emulsions with reduced, substantially no, or even no use of emulsifiers, such as anionic surfactants, have not been successful. For example, it has not been possible to provide emulsions of carnauba wax alone containing reduced or with substantially no surfactant. However, it has been discovered that this difficulty can be overcome by forming the wax emulsion together with the resin. That is, while emulsions of carnauba wax having reduced or with substantially no surfactant alone cannot be made, it is possible to solvent flash the carnauba wax together with resin, such as amorphous polyester resin such as propoxylated bisphenol A fumarate resin, in the absence of a surfactant or with a reduced amount of surfactant.

To incorporate the wax into the toner formulation with reduced or with substantially no surfactant as the emulsifier, the wax is mixed with all or part of the resin component, in the weight ratio desired in the final toner formulation. The wax and resin are dissolved in a suitable organic solvent under conditions that allow the solution to be formed. Suitable solvents that can be used include those in which the resin and wax is soluble, and that dissolve the resin and wax components to form an emulsion, but which solvents can be subsequently flashed off to leave said resin and wax in an emulsion, such as in water, at the desired particle size. For example, suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. Particular solvents that can be used include acetone, methyl ethyl ketone, cyclohexanone, methyl acetate, ethyl acetate, dimethylsulfoxide, and mixtures thereof. If desired or necessary, the wax and resin can be dissolved in the solvent at elevated temperature, such as about 40 to about 80° C. or about 50 to about 70° or about 60 to about 65° C., although the temperature is desirable lower than the glass transition temperature of the wax and resin. In embodiments, the wax and resin are dissolved in the solvent at elevated temperature, but below the boiling point of the solvent, such as at about 2 to about 15° C. or about 5 to about 10° C. below the boiling point of the solvent.

After the wax and resin are dissolved in the solvent, the resin and wax solution is mixed into an emulsion medium, for example water such as deionized water containing a stabilizer, and optionally a surfactant. Examples of suitable stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present at a level of from about 0.1 to about 5 percent, such as about 0.5 to about 3 percent by weight of the wax and resin. When such salts are added to the composition as a stabilizer, it is desired in embodiments that incompatible metal salts are not present in the composition. For example, when these salts are used the composition should be completely or essentially free of zinc and other incompatible metal ions, e.g. Ca, Fe, Ba, etc. which form water-insoluble salts. The term "essentially free" refers, for example, to the incompatible metal ions as present at a level of less than about 0.01 percent, such as less than about 0.005 or less than about 0.001 percent by weight of the wax and resin. If desired or necessary, the stabilizer can be added to the mixture at ambient temperature, or it can be heated to the mixture temperature prior to addition.

Optionally, it may be desirable to add an additional stabilizer such as a surfactant to the aqueous emulsion medium such as to afford additional stabilization to the resin and wax particles, albeit at a reduced level as compared to conventional wax emulsions. Suitable surfactants include anionic, cationic and nonionic surfactants. In embodiments, the use of anionic and nonionic surfactants can additionally help stabilize the aggregation process in the presence of the coagulant, which otherwise could lead to aggregation instability.

Anionic surfactants include sodium dodecylsulfate (SDS), sodium dodecyl benzene sulfonate, sodium dodecyinaphthalene sulfate, dialkyl benzenealkyl, sulfates and sulfonates, abitic acid, and the NEOGEN brand of anionic surfactants. An example of a suitable anionic surfactant is NEOGEN R-K available from Daiichi Kogyo Seiyaku Co. Ltd. (Japan), or TAYCAPOWER BN2060 from Tayca Corporation (Japan), which consists primarily of branched sodium dodecyl benzene sulfonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. An example of a suitable cationic surfactant is SANISOL B-50 available from Kao Corporation, which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL CA-210, IGEPAL CA-520, IGEPAL CA-720, IGEPAL CO-890, IGEPAL CO-720, IGEPAL CO-290, IGEPAL CA-210, ANTAROX 890 and ANTAROX 897. An example of a suitable nonionic surfactant is ANTAROX 897 available from Rhone-Poulenc Inc., which consists primarily of alkyl phenol ethoxylate.

After the stabilizer or stabilizers are added, the resultant mixture can be mixed or homogenized for any desired time.

Next, the mixture is heated to flash off the solvent, and then cooled to room temperature. For example, the solvent flashing can be conducted at any suitable temperature above the boiling point of the solvent in water that will flash off the solvent, such as about 60 to about 100° C., for example about 70 to about 90° C. or about 80° C., although the temperature may be adjusted based on, for example, the particular wax, resin, and solvent used.

Following the solvent flash step, the polyester resin and wax particles in embodiments have an average particle diameter in the range of about 100 to about 500 nanometers, such as from about 130 to about 300 nanometers as measured with a Honeywell MICROTRAC® UPA150 particle size analyzer.

The polyester resin and wax in embodiments is present in said resin and wax emulsions in an amount of from about 5 to about 50 percent by weight, such as from about 10 to about 40 percent by weight. However, amounts outside these ranges can be used.

The toners also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 1 percent to about 25 percent by weight based upon the total weight of the composition. It is to be understood that other useful colorants will become readily apparent based on the present disclosures.

In general, useful colorants include PALIOGEN VIOLET 5100 and 5890 (BASF), NORMANDY MAGENTA RD-2400 (Paul Uhlrich), PERMANENT VIOLET VT2645 (Paul Uhlrich), HELIOGEN GREEN L8730 (BASF), ARGYLE GREEN XP-111-S (Paul Uhlrich), BRILLIANT GREEN TONER GR 0991 (Paul Uhlrich), LITHOL SCARLET D3700 (BASF), TOLUIDINE RED (Aldrich), SCARLET FOR THERMOPLAST NSD RED (Aldrich), LITHOL RUBINE TONER (Paul Uhlrich), LITHOL SCARLET 4440, NBD 3700 (BASF), BON RED C (Dominion Color), ROYAL BRILLIANT RED RD-8192 (Paul Uhlrich), ORACET PINK RF (Ciba Geigy), PALIOGEN RED 3340 and 3871K (BASF), LITHOL FAST SCARLET L4300 (BASF), HELIOGEN BLUE D6840, D7080, K7090, K6910 and L7020 (BASF), SUDAN BLUE OS (BASF), NEOPEN BLUE FF4012 (BASF), PV FAST BLUE B2G01(American Hoechst), IRGALITE BLUE BCA (Ciba Geigy), PALIOGEN BLUE 6470 (BASF), SUDAN II, III and IV (Matheson, Coleman, Bell), SUDAN ORANGE (Aldrich), SUDAN ORANGE 220 (BASF), PALIOGEN ORANGE 3040 (BASF), ORTHO ORANGE OR 2673 (Paul Uhlrich), PALIOGEN YELLOW 152 and 1560 (BASF), LITHOL FAST YELLOW 0991K (BASF), PALIOTOL YELLOW 1840 (BASF), NOVAPERM YELLOW FGL (Hoechst), PERMANERIT YELLOW YE 0305 (Paul Uhlrich), LUMOGEN YELLOW D0790 (BASF), SUCO-GELB 1250 (BASF), SUCO-YELLOW D1355 (BASF), SUCO FAST YELLOW D1165, D1355 and D1351 (BASF), HOSTAPERM PINK E (Hoechst), FANAL PINK D4830 (BASF), CINQUASIA MAGENTA (DuPont), PALIOGEN BLACK L9984 9BASF), PIGMENT BLACK K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 percent by weight of the toner particles on a solids basis, such as from about 5 to about 25 percent by weight or from about 5 to about 15 percent by weight. However, amounts outside these ranges can also be used, in embodiments.

The toners of the present disclosure may also contain a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound Such coagulants can be incorporated into the toner particles during particle aggregation. As such, the coagulant can be present in the toner particles, exclusive of external additives and on a dry weight basis, in amounts of from 0 to about 5 percent by weight of the toner particles, such as from about greater than 0 to about 3 percent by weight of the toner particles.

The toner may also include additional known positive or negative charge additives in effective suitable amounts of, for example, from about 0.1 to about 5 weight percent of the toner, such as quaternary ammonium compounds inclusive of alkyl pyridinium halides, bisulfates, organic sulfate and sulfonate compositions such as disclosed in U.S. Pat. No. 4,338,390, cetyl pyridinium tetrafluoroborates, distearyl dimethyl ammonium methyl sulfate, aluminum salts or complexes, and the like.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide and the like, among others.

Examples of the acids that can be utilized include organic and inorganic acids such as, for example, nitric acid, sulfuric acid, hydrochloric acid, acetic acid, citric acid, trifluoro acetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Any suitable emulsion aggregation procedure may be used in forming the emulsion aggregation toner particles without restriction. These procedures typically include the basic process steps of at least aggregating an emulsion containing polymer binder and one or more waxes, one or more colorants, one or more surfactants, an optional coagulant, and one or more additional optional additives to form aggregates, subsequently coalescing or fusing the aggregates, and then recovering, optionally washing and optionally drying the obtained emulsion aggregation toner particles. However, in embodiments, the process utilizes a combined wax and resin emulsion, which is produced by a solvent flash process, rather than separate resin and wax emulsions.

Benefits of the solvent flash preparation of the wax and resin emulsion include that the resin and wax in said emulsion having reduced or substantially no surfactant can be substantially incorporated in the aggregated and coalesced toner. The reduced amount of surfactants present in the process, and thus in the final toner composition, helps to provide more robust and repeatable aggregation and coalescence process performance.

A reduced amount of surfactants present in the process, and thus in the final toner composition, also means that there is less surfactant present that must be removed in a subsequent washing step. The washing step to remove surfactant is necessary to allow for satisfactory charging performance of the toner. Still further, emulsification of the resin and wax together reduces the need to emulsify the wax separately, thereby reducing the cost of the emulsification step.

Suitable emulsion aggregation/coalescing processes for the preparation of toners, and which can be modified to include the solvent flash emulsion preparation as described herein, are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,346; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. patents may be selected for the present composition and process in embodiments thereof.

In embodiments hereof, the toner process comprises forming a wax and resin emulsion by solvent flashing as described above, mixing the wax and resin emulsion with deionized water, to which is added a colorant dispersion and/or a wax dispersion and an optional coagulant while blending at high speeds such as with a polytron. The resulting mixture is further aggregated by adding aqueous solution of acid until the pH of the mixture is from about 4.0 to about 5.5, and heating to a temperature of from about 30° C. to 60° C., wherein the aggregate grows to a size of from about 3 to about 20 microns. The pH of the mixture is then changed, for example by the addition of a sodium hydroxide solution until a pH of about 7 to 9 and the mixture is heated to above the resin Tg, such as to about 75° C. to about 95° C., and the pH is optionally decreased to a range of 6.0 to 6.8. The coalesced particles can be measured for shape factor or circularity, such as with a Sysmex FPIA 2100 analyzer, until the desired shape is achieved.

The mixture is allowed to cool to room temperature (about 20° C. to about 25° C.) and is optionally washed to remove the surfactant. The toner is then optionally dried.

The toner particles of the present disclosure can be made to have the following physical properties when no external additives are present on the toner particles.

The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.15 to approximately 1.30, or approximately less than 1.25. The toner particles of the present disclosure also can have a size such that the upper geometric standard deviation (GSD) by volume is in the range of from about 1.15 to about 1.30, such as from about 1.18 to about 1.22, or less than 1.25. These GSD values for the toner particles of the present disclosure indicate that the toner particles are made to have a very narrow particle size distribution.

Shape factor is also a control process parameter associated with the toner being able to achieve optimal machine performance. The toner particles can have a shape factor of about 105 to about 170, such as about 110 to about 160, SF1*a. Scanning electron microscopy (SEMI) is used to determine the shape factor analysis of the toners by SEM and image analysis (IA) is tested. The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area. In addition to measuring shape factor SF, another metric to measure particle circularity is being used on a regular basis. This is a faster method to quantify the particle shape. The instrument used is an FPIA-2100 manufactured by Sysmex. For a completely circular sphere the circularity would be 1.000. The toner particles can have circularity of about 0.920 to 0.990 and, such as from about 0.940 to about 0.980.

It is desirable in embodiments that the toner particle has separate crystalline polyester and wax melting points and amorphous polyester glass transition temperature as measured by DSC, and that the melting temperatures and glass transition temperature are not substantially depressed by plastification of the amorphous or crystalline polyesters by the wax.

The toner particles can be blended with external additives following formation. Any suitable surface additives may be used in embodiments. Most suitable are one or more of $SiO_2$, metal oxides such as, for example, $TiO_2$ and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is optionally also used as an external additive for the toners of the disclosure, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. In embodiments, a commercially available zinc stearate known as Zinc Stearate L, obtained from Ferro Corporation, can be used. The external surface additives can be used with or without a coating.

In embodiments, the toners contain from, for example, about 0.1 to about 5 weight percent titania, about 0.1 to about 8 weight percent silica and about 0.1 to about 4 weight percent zinc stearate.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 to about 10 percent by weight of toner and about 90 to about 98 percent by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

It is envisioned that the toners of the present disclosure may be used in any suitable procedure for forming an image with a toner, including in applications other than xerographic applications.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Five examples are provided below. Example I describes a process for producing a substantially surfactantless emulsion containing propoxylated bisphenol A fumarate amorphous resin and carnauba wax stabilized with sodium bicarbonate. Example II and III describe a processes for producing an emulsion containing propoxylated bisphenol A fumarate amorphous resin and stearyl stearamide wax and carnauba wax, respectively, stabilized with ammonium hydroxide and low levels of anionic surfactant. Example IV describes a process for producing a substantially surfactantless emulsion containing CPES-A11 crystalline polyester resin (Kao Corp., Japan) stabilized with sodium bicarbonate. Example V describes a process for producing an ultra low melt toner with excellent fusing, A zone charging and cohesion performance wherein the emulsions of Examples I and IV are utilized as ingredients.

Example I 113.2 grams of amorphous propoxylated bisphenol A fumarate resin and 11.8 grams of RC-160 carnauba wax (Toa Kasei Co., Ltd., Japan) is measured into a 2 liter beaker containing about 917 grams of ethyl acetate. The resin has an acid number of about 16.7 as measured by titration with KOH, weight average and number average molecular weight of about 12,000 and 4,200 respectively as measured by GPC and onset glass transition temperature of about 56° C. as measured by DSC. The wax has a melting point of about 84° C. as measured by DSC. The mixture is stirred at about 250 revolutions per minute and heated to about 67° C. to dissolve the resin and wax in the ethyl acetate. 3.05 grams of sodium bicarbonate are measured into a 4 liter PYREX glass flask reactor containing about 708 grams of deionized water and heated to about 65° C. Homogenization of the heated water solution in the 4 liter glass flask reactor is commenced with an IKA ULTRA TURRAX T50 homogenizer at about 4,000 revolutions per minute. The heated resin and wax solution is then slowly poured into the water solution as the mixture continues to be homogenized, the homogenizer speed is increased to about 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of the mixture is increased to about 80° C. at about 1° C. per minute to distill off the ethyl acetate from the mixture. Stirring of the mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. The resulting resin and wax emulsion is comprised of about 18.8 percent by weight solids in water as measured gravimetrically wherein the solid contains 9.4percent by weight of wax and 90.6 percent by weight of amorphous polyester resin, has a volume average diameter of about 176 nanometers as measured with a HONEYWELL MICROTRAC® UPA150 particle size analyzer, and has an onset Tg (resin portion) of about 57° C. and peak melting point (wax portion) of about 83° C. as measured by DSC. Since there is substantially no drop in the resin Tg portion of the emulsion, it can be concluded that there is substantially no plastification of the resin by the wax during emulsification.

Example II 56.6 grams of amorphous propoxylated bisphenol A fumarate resin, 56.6 g grams of branched amorphous propoxylated bisphenol A fumarate resin and 11.8 grams of KEMAMIDE S-180 stearyl stearamide wax (Crompton-Witco, USA) is measured into a 2 liter beaker containing about 917 grams of ethyl acetate. The unbranched amorphous resin has an acid number of about 16.7 as measured by titration with KOH, weight average and number average molecular weight of about 12,000 and 4,200 respectively as measured by GPC and onset glass transition temperature of about 56° C. as measured by DSC. The branched amorphous resin has an acid number of about 14.7, weight average and number average molecular weight of about 34,700 and 5,600 and onset glass transition temperature of about 57° C. The wax has a melting point of about 95° C. as measured by DSC. The mixture is stirred at about 250 revolutions per minute and heated to about 67° C. to dissolve the resin and wax in the ethyl acetate. 3.0 grams of concentrated ammonium hydroxide and 1.4 grams of DOWFAX 2A1anionic surfactant are measured into a 4 liter PYREX glass flask reactor containing about 708 grams of deionized water and heated to about 65° C. Homogenization of the heated water solution in the 4 liter glass flask reactor is commenced with an IKA ULTRA TURRAX T50 homogenizer at about 4,000 revolutions per minute. The heated resin and wax solution is then slowly poured into the water solution as the mixture continues to be homogenized, the homogenizer speed is increased to about 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of the mixture is increased to about 80° C. at about 1° C. per minute to distill off the ethyl acetate from the mixture. Stirring of the mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. The resulting resin and wax emulsion is comprised of about 21.7 percent by weight solids in water as measured gravimetrically wherein the solid contains 9.4 percent by weight of wax and 90.6 percent by weight of amorphous polyester resin, has a volume average diameter of about 173 nanometers as measured with a HONEYWELL MICROTRAC® UPA150 particle size analyzer, and has an onset Tg (resin portion) of about 57° C. and peak melting point (wax portion) of about 94° C. as measured by DSC. Since there is substantially no drop in the resin Tg portion of the emulsion, it can be concluded that there is substantially no plastification of the resin by the wax during emulsification. From the DSC results of said emulsion, there is substantially no drop in the Tg and therefore there is substantially no plastification of the resin by the wax.

Example III 56.6 grams of amorphous propoxylated bisphenol A fumarate resin, 56.6 g grams of branched amorphous propoxylated bisphenol A fumarate resin and 11.8 grams of RC-160 carnauba wax is measured into a 2 liter beaker containing about 917 grams of ethyl acetate. The unbranched amorphous resin has an acid number of about 16.7 as measured by titration with KOH, weight average and number average molecular weight of about 12,000 and 4,200 respectively as measured by GPC and onset glass transition temperature of about 56° C. as measured by DSC. The branched amorphous resin has an acid number of about 14.7, weight average and number average molecular weight of about 34,700 and 5,600 and onset glass transition temperature of about 57° C. The wax has a melting point of about 95° C. as measured by DSC. The mixture is stirred at about 250 revolutions per minute and heated to about 67° C. to dissolve the resin and wax in the ethyl acetate. 3.0 grams of concentrated ammonium hydroxide and 1.4 grams of DOWFAX 2A1 anionic surfactant are measured into a 4 liter PYREX glass flask reactor containing about 708 grams of deionized water and heated to about 65° C. Homogenization of the heated water solution in the 4 liter glass flask reactor is commenced with an IKA ULTRA TURRAX T50 homogenizer at about 4,000 revolutions per minute. The heated resin and wax solution is then slowly poured into the water solution as the mixture continues to be homogenized, the homogenizer speed is increased to about 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of the mixture is increased to about 80° C. at about 1° C. per minute to distill off the ethyl acetate from the mixture. Stirring of the mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. The resulting resin and wax emulsion is comprised of about 18.4 percent by weight solids in water as measured gravimetrically wherein the solid contains 9.4 percent by weight of wax and 90.6 percent by weight of amorphous polyester resin, has a volume average diameter of about 176 nanometers as measured with a HONEYWELL MICROTRAC® UPA150 particle size analyzer, and has an onset Tg (resin portion) of about 56° C. and peak melting point (wax portion) of about 84° C. as measured by DSC. Since there is substantially no drop in the resin Tg portion of the emulsion, it can be concluded that there is substantially no plastification of the resin by the wax during emulsification. From the DSC results of said emulsion, there is substantially no drop in the Tg and therefore there is substantially no plastification of the resin by the wax.

Example IV 125 grams of semi-crystalline CPES-A11 polyester resin (Kao Corporation, Japan) is measured into a 2 liter beaker containing about 917 grams of ethyl acetate. The polyester resin has an acid number of about 13.2 as measured by titration with KOH, weight average and number average molecular weight of about 13,600 and 6,700 respectively as measured by DSC and melting point of about 86° C. as measured by DSC. The mixture is stirred at about 250 revolutions per minute and heated to about 65° C. to dissolve the resin in the ethyl acetate. 2.4 grams of sodium bicarbonate are measured into a 4 liter PYREX glass flask reactor containing about 708 grams of deionized water and heated to about 65° C. Homogenization of the heated water solution in the 4 liter glass flask reactor is commenced with an IKA ULTRA TURRAX T50 homogenizer at about 4,000 revolutions per minute. The heated resin and wax solution is the slowly poured into the water solution as the mixture continues to be homogenized, the homogenizer speed is increased to about 10,000 revolutions per minute and homogenization is carried out at these conditions for about 30 minutes. At completion of homogenization, the glass flask reactor and its contents are placed in a heating mantle and connected to a distillation device. The mixture is stirred at about 400 revolutions per minute and the temperature of the mixture is increased to about 80° C. at about 1° C. per minute to distill off the ethyl acetate from the mixture. Stirring of the mixture is continued at 80° C. for about 120 minutes followed by cooling at about 2° C. per minute to room temperature. The product is screened through a 20 micron sieve and the pH is adjusted to 7.0 with the addition of 1.0 Normal sodium hydroxide. The resulting resin emulsion is comprised of about 21.9 percent by weight crystalline polyester resin in water as measured gravimetrically and has a volume average diameter of about 282 nanometers as measured with a HONEYWELL MICROTRAC® UPA150 particle size analyzer.

Example V

A 2 liter kettle, equipped with a mechanical stirrer and heating mantle is charged with 374 grams of emulsion of Example I comprised of amorphous propoxylated bisphenol A fumarate resin and carnauba wax in water, 72.4 grams of emulsion of Example IV comprising of crystalline polyester resin in water, and 370 grams of deionized water. The mixture is homogenized at about 2,000 revolutions per minute, followed by the addition of 25.9 grams of pigment dispersion comprising about 17 per cent by weight of Pigment Blue 15:3 cyan pigment, followed by a drop wise addition of 71 grams of a 0.3 Normal solution of nitric acid. During the acid addition, the homogenization is increased to about 4,500 revolutions per minute and maintained for about 5 minutes. The mixture is then stirred at about 175 revolutions per minute, and heated to about 36.5° C. followed by adding 4.5 gram solution of Taycapower BN2060 anionic surfactant (17.5 percent solids by weight; Tayca Corporation, Japan), and the pH of the mixture is increased from about 3.3 to about 6.82 with the addition of 4 percent sodium hydroxide solution. The stirring is reduced to about 70 revolutions per minute, and the mixture heated to about 67.5° C., followed by decreasing the pH to about 6.0 by the addition of a 0.3 Normal solution of nitric acid. The toner of this mixture comprises about 69.2 per cent by weight of amorphous polyester resin, about 17.3 per cent by weight of crystalline polyester resin, about 9 per cent by weight of wax and about 4.5 percent by weight of pigment, and has a volume average particle size of about 7.65 microns as measured with a COULTER COUNTER and a circularity of about 0.96 as measured with a SYSMEX® FPIA-2100 flow-type histogram analyzer.

Comparative Example I

A cyan toner particle was prepared using the same formulation and process conditions as the Example V, except that separate polyester resin emulsion and wax emulsion are used, rather than the combined resin and wax emulsion of Example I. The wax emulsion is a carnauba wax emulsion stabilized with Taycapower BN2060 anionic surfactant. The respective toners of Example III and Comparative Example I are tested for their development properties, including charging and cohesion of the toner particles. The results are presented in Table 1, below.

TABLE 1

| | Example V | Comparative Example I |
|---|---|---|
| Pellet resistivity | $6.9 \times 10^{12}$ | $6.3 \times 10^{12}$ |
| Charging (28° C., 80-85 percent RH) | 4.9 | 4.5 |
| Charging (10° C., 52 percent RH) | 9.8 | 6.3 |
| Blocking (40° C., 85 percent RH) | 7.8 | 12.9 |
| Additive charging (28° C., 80-85 percent RH) | 4.3 | 9.3 |
| Additive charging (10° C., 52 percent RH) | 13.5 | 24.8 |
| RH Ratio | 0.32 | 0.38 |

Comparing the results in Table 1, it is apparent that the toner of Example V, which includes less surfactant due to the surfactantless wax and resin emulsion, exhibits improved results as compared to Comparative Example I that uses separate surfactant-containing resin and wax emulsions. The toner of Example V exhibits significantly improved performance in additive charging at low temperature/moderate humidity conditions, and exhibits significantly improved relative humidity sensitivity as exhibited by the RH ratio. The toner of Example V also exhibits improved blocking performance at high temperature/high humidity conditions wherein a lower blocking value is indicative of freer powder flow.

SEM micrographs of the produced toners were made. Inspection of the micrographs shows that the surface of the toner of Example III is significantly cleaner than the surface of the toner of Comparative Example I. That is, in the toner of Example III, the wax appears to be more uniformly incorporated into the toner particles, as compared to wax particles being adhered to the surface of the toner of Comparative Example I. The surface of the toner of Example III is thus smoother as compared to a relatively bumpy surface for the toner of Comparative Example I.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for preparing a toner, comprising:

solvent flashing wax and resin together to emulsify the resin and wax to a sub-micron size;

mixing the wax and resin emulsion with a colorant, and optionally a coagulant to form a mixture;

heating the mixture at a temperature below a glass transition temperature of said resin to aggregate said resin, colorant, and wax, to form aggregated particles;

heating the aggregated particles and coalescent agent at a temperature above the glass transition temperature of said resin, to coalesce said aggregated particles to form toner particles, optionally cooling the mixture; and isolating the toner particles, wherein the solvent flashing comprises:

dissolving the wax and resin in an organic solvent;

mixing the wax, resin and solvent into an emulsion medium comprising water and a stabilizer to form a wax and resin emulsion;

mixing the wax and resin emulsion; and heating the wax and resin emulsion to flash off the solvent.

2. The process of claim 1, wherein the wax is soluble in the solvent and at a temperature used to dissolve the resin in the solvent.

3. The process of claim 1, wherein the solvent is selected from the group consisting of alcohols, ketones, esters, ethers, chlorinated solvents, nitrogen containing solvents, and mixtures thereof.

4. The process of claim 1, wherein the solvent is selected from the group consisting of acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, and mixtures thereof.

5. The process of claim 1, wherein the dissolving is conducted at a temperature of from about 40 to about 80° C.

6. The process of claim 1, wherein the dissolving is conducted at a temperature of from about 2 to about 15° C. below a boiling point of the solvent.

7. The process of claim 1, wherein the stabilizer is selected from the group consisting of water-soluble alkali metal hydroxides, ammonium hydroxide, alkali metal carbonates, and alkali metal bicarbonates.

8. The process of claim 1, wherein the stabilizer is selected from the group consisting of sodium hydroxide, potassium hydroxide, lithium hydroxide, beryllium hydroxide, magnesium hydroxide, calcium hydroxide, barium hydroxide, ammonium hydroxide, sodium bicarbonate, lithium bicarbonate, potassium bicarbonate, lithium carbonate, potassium carbonate, sodium carbonate, beryllium carbonate, magnesium carbonate, calcium carbonate, barium carbonate, cesium carbonate, and mixtures thereof.

9. The process of claim 1, wherein the stabilizer is present in an amount of from about 0.1 to about 5 percent by weight of the wax and resin.

10. The process of claim 1, wherein the wax and resin emulsion is substantially free of surfactant.

11. The process of claim 1, wherein the wax and resin emulsion further comprises a surfactant.

12. The process of claim 1, wherein the wax and resin emulsion is free of surfactant.

13. The process of claim 1, wherein the wax does not substantially plastify the resin.

14. The process of claim 1, wherein the organic solvent comprises ethyl acetate, and the stabilizer comprises sodium bicarbonate.

15. The process of claim 1, further comprising:

adding an organic or an inorganic acid to said mixture before heating the mixture at a temperature below the glass transition temperature of said resin; and adding a base to said aggregated particles before heating the mixture at a temperature above the glass transition temperature of said resin.

16. The process of claim 1, wherein the resin is a polyester resin.

17. The process of claim 1, wherein the resin is a non-sulfonated polyester resin.

18. The process of claim 1, wherein the resin is selected from the group consisting of polyester resins, branched polyester resins, polyimide resins, branched polyimide resins, poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and crystalline polyester resins.

19. The process of claim 1, wherein the resin is selected from the group consisting of an amorphous resin, a crystalline resin, a mixture of two or more amorphous resins, and a mixture of two or more crystalline resins.

20. The process of claim 19, wherein:

the amorphous resin is an amorphous polyester resin selected from the group consisting of polyethylene-terephthalate, polypropylene-terephthalate, polybutylene-terephthalate, polypentylene-terephthalate, polyhexylene-terephthalate, polyheptylene-terephthalate, polyoctylene-terephthalate, polyethylene-sebacate, polypropylene sebacate, polybutylene-sebacate, polyethylene-adipate, polypropylene-adipate, polybutylene-adipate, polypentylene-adipate, polyhexylene-adipate, polyheptylene-adipate, polyoctylene-adipate, polyethylene-glutarate, polypropylene-glutarate, polybutylene-glutarate, polypentylene-glutarate, polyhexylene-glutarate, polyheptylene-glutarate, polyoctylene-glutarate, polyethylene-pimelate, polypropylene-pimelate, polybutylene-pimelate, polypentylene-pimelate, polyhexylene-pimelate, polyheptylene-pimelate, poly(propoxylatedbisphenol-fumarate), poly(propoxylated bisphenol-succinate), poly(propoxylated bisphenol-adipate), poly(propoxylated bisphenol-glutarate), and mixtures thereof; and the crystalline resin is a crystalline polyester resin selected from the group consisting of poly(ethylene-adipate), poly(propylene-adipate), poly(butylene-adipate), poly (pentylene-adipate), poly(hexylene-adipate), poly(octylene-adipate), poly(ethylene-succinate), poly(propylene-succinate), poly(butylene-succinate), poly (pentylene-succinate), poly(hexylene-succinate), poly (octylene-succinate), poly(ethylene-sebacate), poly (propylene-sebacate), poly(butylene-sebacate), poly (pentylene-sebacate), poly(hexylene-sebacate), poly (octylene-sebacate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly (5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-succinate), copoly(5-sulfo-isophthaloyl)-copoly(propylene-succinate), copoly(5-sulfo-isophthaloyl)-copoly(butylene-succinale), copoly(5-sulfo-isophthaloyl)-copoly(pentylene-succinate), copoly(5-sulfo-isophthaloyl)-copoly (hexylene-succinate), copoly(5-sulfo-isophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly (octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly (5-sulfo-isophthaloyl)-copoly(pentylene-adipate), copoly(5-sulfo-isophthaloyl)-copoly(hexylene-adipate), poly(octylene-adipate), and mixtures thereof.

21. The process of claim 1, wherein the coagulant is present in the toner particles, exclusive of any optional external additives, and on a dry weight basis, in an amount of from 0 to about 5% by weight of the toner particles and is selected from the group consisting of aluminum sulfate, polyaluminum halides, polyaluminum silicates, polyaluminum hydroxides, and polyaluminum phosphate.

22. The process of claim 1, wherein the wax is selected from the group consisting of natural vegetable waxes, natural animal waxes, mineral waxes, synthetic waxes and functionalized waxes.

23. The process of claim 1, wherein the wax is selected from the group consisting of carnauba wax, candelilla wax, Japan wax, bayberry wax, beeswax, punic wax, lanolin, lac wax, shellac wax, spermaceti wax, paraffin wax, microcrystalline wax, montan wax, ozokerite wax, ceresin wax, petrolatum wax, petroleum wax, Fischer-Tropsch wax, acrylate wax, fatty acid amide wax, silicone wax, polytetrafluoroethylene wax, polyethylene wax, and polypropylene wax, and mixtures thereof.

24. The process of claim 1, wherein the colorant comprises a pigment, a dye, or mixtures thereof, in an amount of from about 1% to about 25% by weight based upon the total weight of the toner.

* * * * *